US010611436B2

(12) United States Patent
Haynes et al.

(10) Patent No.: US 10,611,436 B2
(45) Date of Patent: Apr. 7, 2020

(54) SEA ANCHOR

(71) Applicant: GOODRICH COPRORATION, Charlotte, NC (US)

(72) Inventors: Timothy C. Haynes, Prescott Valley, AZ (US); Ryan Schmidt, Gilbert, AZ (US)

(73) Assignee: GOODRICH CORPORATION, Charlotte, NC (US)

( * ) Notice: Subject to any disclaimer, the term of this patent is extended or adjusted under 35 U.S.C. 154(b) by 75 days.

(21) Appl. No.: 15/896,855

(22) Filed: Feb. 14, 2018

(65) Prior Publication Data

US 2019/0248449 A1 Aug. 15, 2019

(51) Int. Cl.

| | |
|---|---|
| ***B63B 21/48*** | (2006.01) |
| ***B63B 21/50*** | (2006.01) |
| ***B63C 9/04*** | (2006.01) |

(52) U.S. Cl.

CPC ..... *B63B 21/48* (2013.01); *B63B 21/50* (2013.01); *B63C 9/04* (2013.01); *B63C 2009/042* (2013.01); *B63C 2009/044* (2013.01)

(58) Field of Classification Search

CPC ..... B64D 17/00; B63B 21/48

See application file for complete search history.

(56) References Cited

U.S. PATENT DOCUMENTS

| | | | | |
|---|---|---|---|---|
| 2,784,425 | A | 3/1957 | Bicknell | |
| 4,733,628 | A | 3/1988 | Baughman | |
| 5,921,830 | A | 7/1999 | Shoaff, III | |
| 6,135,046 | A * | 10/2000 | Beech | B63B 21/48 114/311 |
| 8,382,541 | B1 | 2/2013 | Campbell | |

FOREIGN PATENT DOCUMENTS

| | | | | |
|---|---|---|---|---|
| FR | 2826927 A1 * | 1/2003 | ..... | B63B 39/00 |

* cited by examiner

*Primary Examiner* — Andrew Polay
(74) *Attorney, Agent, or Firm* — Snell & Wilmer L.L.P.

(57) ABSTRACT

A sea anchor includes a textile tube and a resiliently flexible support. The textile tube may include a first end and a second end. The first end may have a rim defining a mouth and the second end may be closed. In various embodiments, the resiliently flexible support is coupled to the first end of the textile tube. The resiliently flexible support, in response to the sea anchor being deployed, may be configured to expand the mouth and retain the mouth open. In various embodiments, the textile tube has a conical shape, with the mouth of the first end being a base of the conical shape and the second end being a point of the conical shape. The resiliently flexible support is a ring coupled to the rim of the first end of the textile tube, according to various embodiments.

4 Claims, 6 Drawing Sheets

SEA ANCHOR

FIELD

The present disclosure relates to sea anchors, and more specifically to a self-deploying sea anchor for a life raft.

BACKGROUND

In the event of an emergency water landing, aircraft typically have one or more life rafts that can be deployed to hold evacuated passengers. These life rafts, as well as boats, ships, yachts, sailing vessels, or other watercraft, often utilize a sea anchor or a drogue to slow the drift of the watercraft and/or to otherwise orient and stabilize the watercraft in a controlled manner. However, most conventional sea anchors are manually deployed and may be susceptible to collapse.

SUMMARY

According to various embodiments, the present disclosure provides a sea anchor that includes a textile tube and a resiliently flexible support. The textile tube may include a first end and a second end. The first end may have a rim defining a mouth and the second end may be closed. In various embodiments, the resiliently flexible support is coupled to the first end of the textile tube. The resiliently flexible support, in response to the sea anchor being deployed, may be configured to expand the mouth and retain the mouth open.

In various embodiments, the textile tube has a conical shape, with the mouth of the first end being a base of the conical shape and the second end being a point of the conical shape. The resiliently flexible support is a ring coupled to the rim of the first end of the textile tube, according to various embodiments. The ring may be sewn into a pocket that extends around the mouth adjacent the rim of the textile tube. In various embodiments, the resiliently flexible support includes a plurality of rings. For example, the ring mentioned above may be a first ring of the plurality of rings, wherein a second ring of the plurality of rings may be coupled to the textile tube at a location between the base and the point of the conical shape. Accordingly, the second ring may have a smaller diameter than the first ring. In various embodiments, the plurality of rings further includes a third ring and a fourth ring. In various embodiments, the resiliently flexible support may include a conic helix wire coupled to the textile tube. The conic helix wire extends in a tapered spiral from the ring towards the point of the conical shape of the textile tube, according to various embodiments.

Also disclosed herein, according to various embodiments, is a life raft that includes an inflatable structure configured to support a passenger and a sea anchor. The sea anchor may be coupled to the inflatable structure. The sea anchor may be automatically deployed in response to inflation of the inflatable structure. The life raft may further include a releasable fastener or a breakable fastener coupling the sea anchor to the inflatable structure, wherein the releasable fastener or breakable fastener is configured to release the sea anchor in response to expansion of the inflatable structure caused by the inflation.

In various embodiments, the sea anchor is coupled in a collapsed shape to the inflatable structure, and a user may release the sea anchor, thereby allowing it to self-deploy, or the act of inflating the life raft may automatically release the sea anchor. That is, the sea anchor may be configured to automatically deploy from the collapsed shape to the expanded shape in response to inflation of the inflatable structure.

Also disclosed herein, according to various embodiments, is a method of using a life raft. The method may include initializing inflation of the life raft and deploying the life raft in water. In response to inflation of the life raft, the sea anchor coupled to the life raft may self-deploy into the water. In various embodiments, the sea anchor is coupled to the life raft in a collapsed shape prior to the inflation of the life raft, and the sea anchor transitions from the collapsed shape to an expanded shape in response to the inflation of the life raft. In various embodiments, the transition from the collapsed shape to the expanded shape propels the sea anchor a distance away from the life raft.

The forgoing features and elements may be combined in various combinations without exclusivity, unless expressly indicated herein otherwise. These features and elements as well as the operation of the disclosed embodiments will become more apparent in light of the following description and accompanying drawings.

Figure 1:
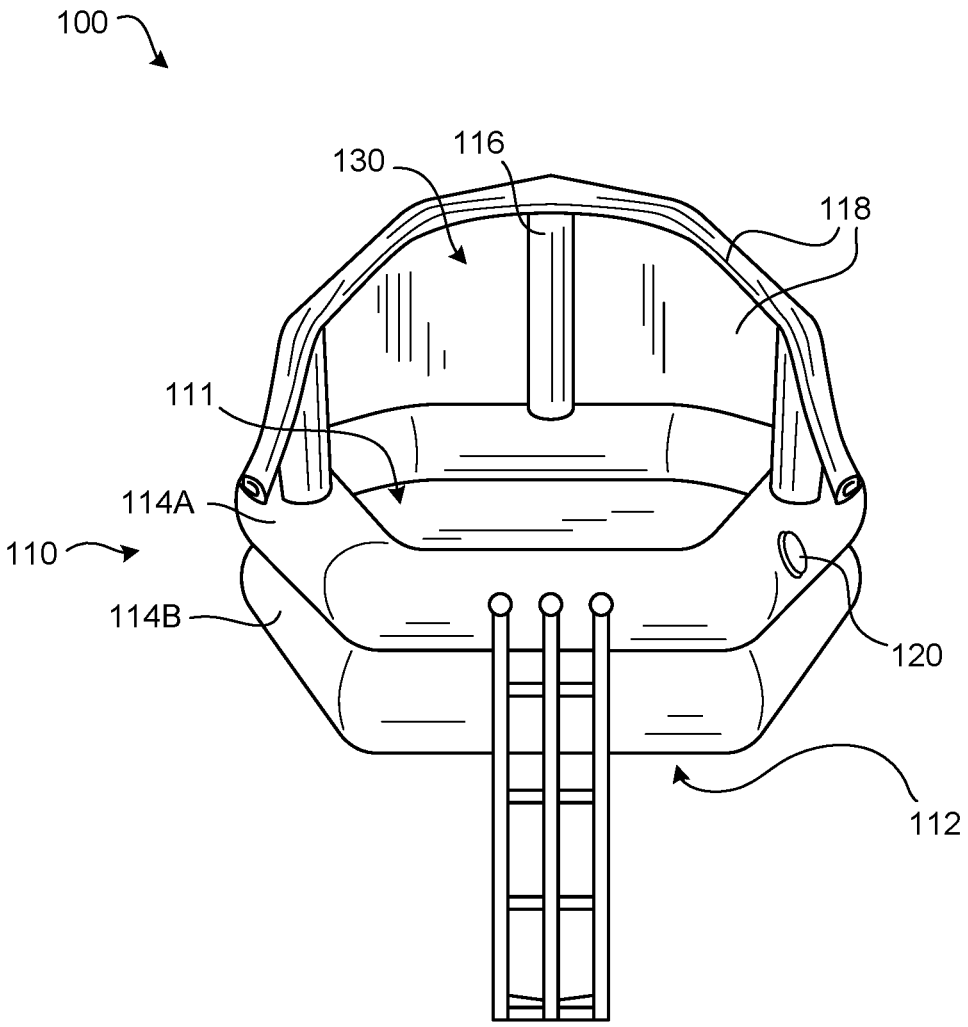
FIG. 1 is a perspective view of a life raft with a sea anchor coupled thereto, in accordance with various embodiments.

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation. Throughout the present disclosure, like reference numbers denote like elements. Accordingly, elements with like element numbering may be shown in the figures but may not be necessarily be repeated herein for the sake of clarity.

In the event of an emergency water landing, aircraft typically have one or more life rafts that can be deployed to hold evacuated passengers. In various embodiments, and with reference to FIG. 1, the present disclosure provides a life raft 100 that includes an inflatable structure 110 and a sea anchor 120 coupled to the inflatable structure 110. While the sea anchor 120 shown in FIG. 1 is shown in a collapsed/packed state, in various embodiments, as described in greater detail below, inflation of the life raft 100 may cause the automatic self-deployment of the sea anchor 120. Accordingly, the sea anchor 120 is generally configured to be self-deploying. In various embodiments, and with reference to FIGS. 1, 2A, and 2B, the sea anchor 120 may include a resiliently flexible support 128 that is configured to expand and retain a mouth 125 of the sea anchor 120 in an open, expanded position. Not only is the resiliently flexible support 128 configured to retain the mouth 125 open, thereby enabling the sea anchor 120 to efficiently and effectively generate drag, but the resiliently flexible support 128 also facilitates self-deployment of the sea anchor itself, as described in greater detail below with reference to FIGS. 2A-6.

The mounting location of the sea anchor 120 is not limited to the location depicted in FIG. 1. That is, the sea anchor 120 may be coupled to different portions of the life raft 100 and/or at different locations relative to the inflatable structure 110. Additionally, despite numerous details and examples herein pertaining to the sea anchor 120 utilized in conjunction with life rafts for aircraft evacuation systems, the structure of the sea anchor 120 and the method of using the life raft 100 and sea anchor 120 may be utilized for other watercraft.

In various embodiments, and with continued reference to FIG. 1, the inflatable structure 110 of the life raft 100 generally includes a base having a first side 111 and a second side 112 opposite the first side 111. In various embodiments, a canopy 118 is coupled to the first side 111 of the inflatable structure 110 and extends across the first side 111 of the inflatable structure 110 to form a first chamber 130 defined between the first side 111 of the inflatable structure 110 and the canopy 118. In various embodiments, the inflatable structure may include one or more inflatable pillars/arches 116 that facilitate holding the canopy in a suspended position. Accordingly, in various embodiments the first side 111 of the inflatable structure 110 of the life raft 100 is a top surface of the life raft 100 upon which passengers are supported in response to the life raft 100 being deployed in water and the second side 112 of the inflatable structure 110 of the life raft 100 may be a bottom surface of the life raft 100 that faces the water. The canopy 118 may function as a protective covering that shields passengers from sun, rain, weather conditions, and other elements.

In various embodiments, the base of the inflatable structure 110 includes one or more inflatable border tubes 114A, 114B. First and second inflatable border tubes 114A, 114B may provide buoyancy to the life raft 100 and may be mounted one above the other. The first and second inflatable border tubes 114A, 114B may provide a degree of buoyancy redundancy in that each inflatable border tube may be independently capable of supporting the weight of the life raft 100 when filled to capacity with passengers. The first inflatable border tube 114A may circumscribe the first side 111 of the base of the inflatable structure 110 and the second inflatable border tube 114B may circumscribe the second side 112 of the base of the inflatable structure 110. The life raft 100 may include one or more ladders, handles, etc., that facilitate passengers embarking.

Figure 2A:
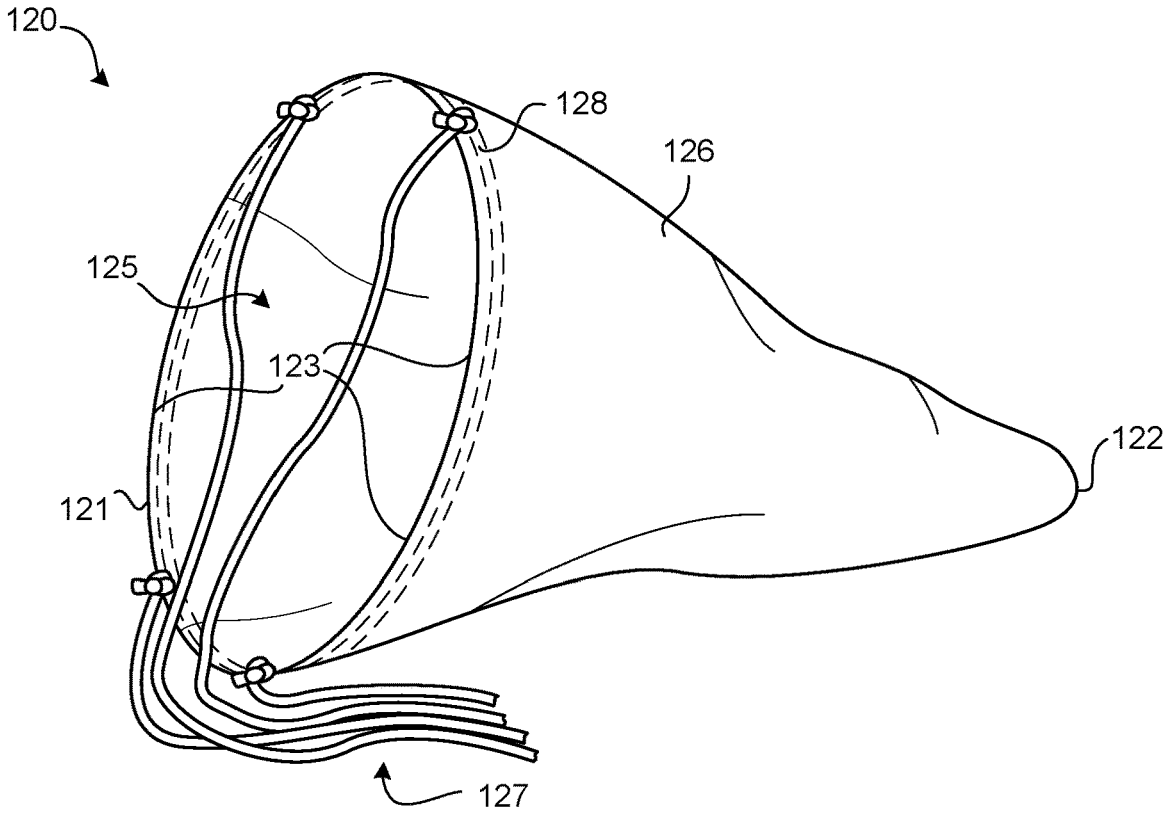
FIG. 2A is a perspective view of a sea anchor having a textile tube and a resiliently flexible support, in accordance with various embodiments.
Figure 2B:
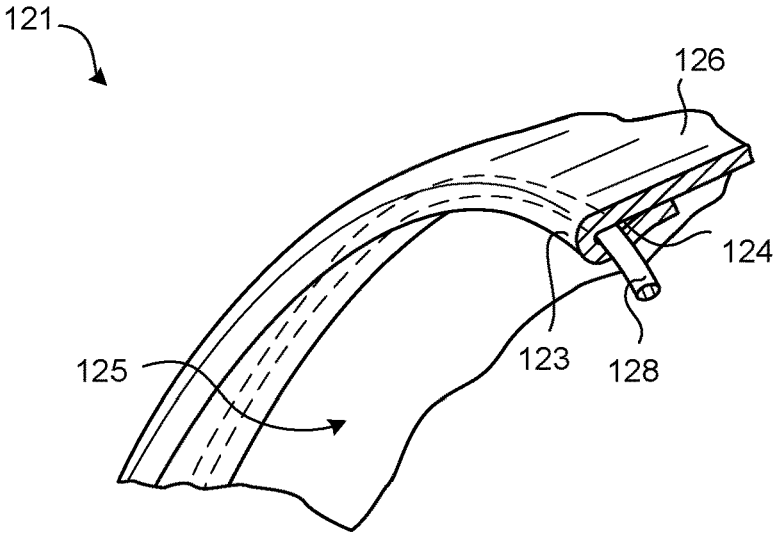
FIG. 2B is a magnified perspective view of a first end of a sea anchor, in accordance with various embodiments.

In various embodiments, and with reference to FIGS. 2A and 2B, the sea anchor 120 includes a textile tube 126 and a resiliently flexible support 128. The textile tube 126 includes a first end 121 and a second end 122, according to various embodiments. The first end 121 has a rim 123 that defines a mouth 125 and the second end 122 is closed, according to various embodiments. The resiliently flexible support 128 is coupled to the first end 121. With the resiliently flexible support 128 coupled to the first end 121 of the textile tube 126, the resiliently flexible support 128 is configured, in response to being deployed, to expand the mouth 125 of the textile tube 126 and retain the mouth 125 open (e.g., in an expanded shape), according to various embodiments. Additionally, the resiliently flexible support 128 may be configured to facilitate the automated self-deployment of the sea anchor 120, as described below with reference to FIGS. 3A, 3B, 3C, and 3D.

In various embodiments, the textile tube 126 has a conical shape. For example, the mouth 125 defined by the rim 123 at the first end 121 of the textile tube 126 may be a base of the conical shape and the second end 122 may be a point of the conical shape. That is, the textile tube 126 tapers inward from the first end 121 to the second end 122, according to various embodiments. The textile tube 126 may be made of a fabric material, a plastic material, or a composite material, among others. For example, the textile tube 126 may be made from nylon or a nylon material coated with a thermoplastic material. In various embodiments, the cross-sectional shape of the textile tube 126 and the mouth 125 may be circular, rectangular, polygonal, etc.

In various embodiments, and with continued reference to FIGS. 2A and 2B, the resiliently flexible support 128 is a ring coupled to, or at least disposed adjacent to, the rim 123 of the first end 121 of the textile tube 126. For example, the resiliently flexible support 128 may be sewn into a pocket 124 that extends around the mouth 125 adjacent the rim 123 of the textile tube 126. The resiliently flexible support 128 may be made from a metallic material, such as a spring steel material. For example, the resiliently flexible support 128 may be made from a spring wire that may facilitate self-deployment of the sea anchor 120, as described in greater detail below. Generally, the resiliently flexible support 128 is compressed in response to being coupled to the textile tube 126, thus causing the resiliently flexible support 128 to exert a radially outward force (e.g., a radially outward bias) relative to the mouth 125 of the textile tube 126, thereby expanding and/or holding the mouth 125 in the open, expanded shape. The material may be corrosion resistant, or the resiliently flexible support 128 may include a corrosion resistant layer/coating. In various embodiments, the sea anchor 120 may also include a tether 127 that has one end mounted to the life raft 100 and the other end attached to the sea anchor 120.

In various embodiments, and with reference to FIGS. 3A, 3B, 3C, and 3D, schematic depictions of the resiliently flexible support 128 in various states, (e.g., various configurations and shapes) are provided. The shapes and components featured in FIGS. 3A-3D are schematic representations of the sea anchor, and thus the textile tube 126 is not shown to prevent obscuring the clarity of the depicted shape transitions. More specifically, FIGS. 3A-3D show stages of the resiliently flexible support 128 transitioning from the expanded shape in FIG. 3A to the collapsed shape in FIG. 3D. While in use, the resiliently flexible support 128 is generally configured to self-deploy from the collapsed shape shown in FIG. 3D to the expanded shape shown in FIG. 3A (i.e., the reverse of what is depicted in FIGS. 3A-3D). The order depicted in the figures is provided because viewing the transitions in the depicted order provides the clearest manner of tracking and explaining how the resiliently flexible support 128 undergoes such shape transitions. Thus, the order of the stages shown in FIGS. 3A-3D is the reverse of what happens to the resiliently flexible support 128 in response to deployment of the sea anchor 120, as described in greater detail below with reference to FIG. 6. Accordingly, the order of the stapes shown in FIGS. 3A-3D may represent a packing process or a method of collapsing the resiliently flexible support 128 in preparation for coupling the sea anchor 120 to the life raft 100 in a packed state.

Figure 3A:
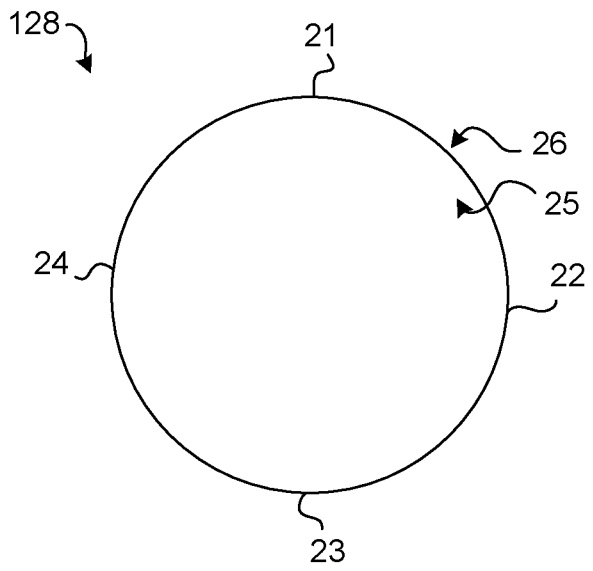
FIGS. 3A, 3B, 3C, and 3D are schematic views of progressive stages of a resiliently flexible support transitioning between an expanded shape and a collapsed shape, in accordance with various embodiments.
Figure 3B:
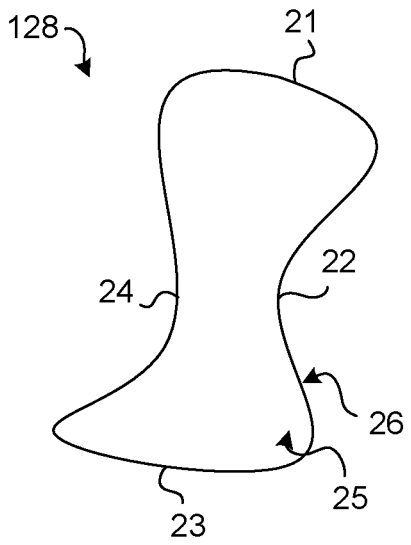
Figure 3C:
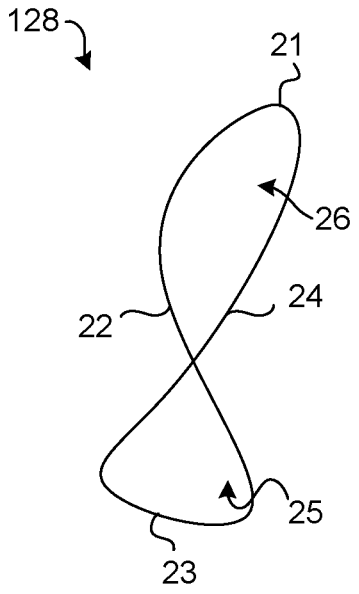
Figure 3D:
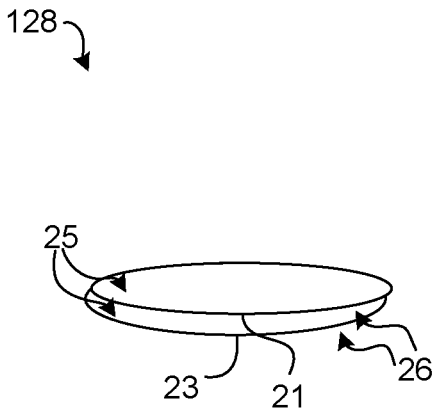

In various embodiments, and with reference to FIG. 3A, the resiliently flexible support 128, in ring-form, is in the expanded shape. Points 21, 22, 23, 24 and faces 25 and 26 are shown herein only for purposes of explaining and clearly showing the transition of the resiliently flexible support 128. Point 21 is disposed opposite point 23 (e.g., top and bottom points, respectively) while point 22 is disposed opposite point 24 (e.g., the side points). Face 25 represents a front, outward face of the mouth 125 while face 26 represents a back, inward face of the mouth 125 defined by the ring that is the resiliently flexible support 128, according to various embodiments. In FIG. 3B, the resiliently flexible support 128 is beginning to twist about an axis extending between points 21 and 23, with point 22 moving from right to left and point 24 moving from left to right. In FIG. 3C, the twisting motion of the resiliently flexible support 128 continues, with point 22 moving from right to left in front of point 24, and with point 24 moving from left to right behind point 22. Also visible in FIG. 3C is the back/inward face 26 of what would be the mouth 125 of the sea anchor 120. In FIG. 3D, the twisting motion has continued until points 22 and 24 are adjacent to each other, and points 21 and 23 are brought together. That is, FIG. 3D represents the resiliently flexible support 128 in a bent-in-half, "figure-8" shape (e.g., the collapsed shape), according to various embodiments.

As mentioned above, the resiliently flexible support 128 may be compressed upon coupling the resiliently flexible support 128 to the textile tube 126, and thus resiliently flexible support 128 may be biased in a generally outward direction and may be prone to rapidly expanding from the collapsed shape shown in FIG. 3D (and shown in FIG. 1, with the sea anchor 120 coupled to the life raft 100) to the expanded shape shown in FIG. 3A. This rapid expansion may be triggered by a user releasing or breaking a fastener, or this rapid expansion may be automatically triggered in response to inflation of the inflatable structure 110 of the life raft 100. That is, the sea anchor 120 may be automatically deployed in response to inflation of the inflatable structure 110. In various embodiments, the life raft 100 further includes a releasable fastener or a breakable fastener. The inflation of the inflatable structure 110 may cause a fastener to release, thereby removing the constraining force that was holding the sea anchor 120 (e.g., the resiliently flexible support 128) in the collapsed shape, thus allowing the resiliently flexible support 128 of the sea anchor 120 to rapidly expand to the expanded shape, thereby self-deploying and propelling the sea anchor 120 away from the life raft 100 and into the water.

Figure 4:
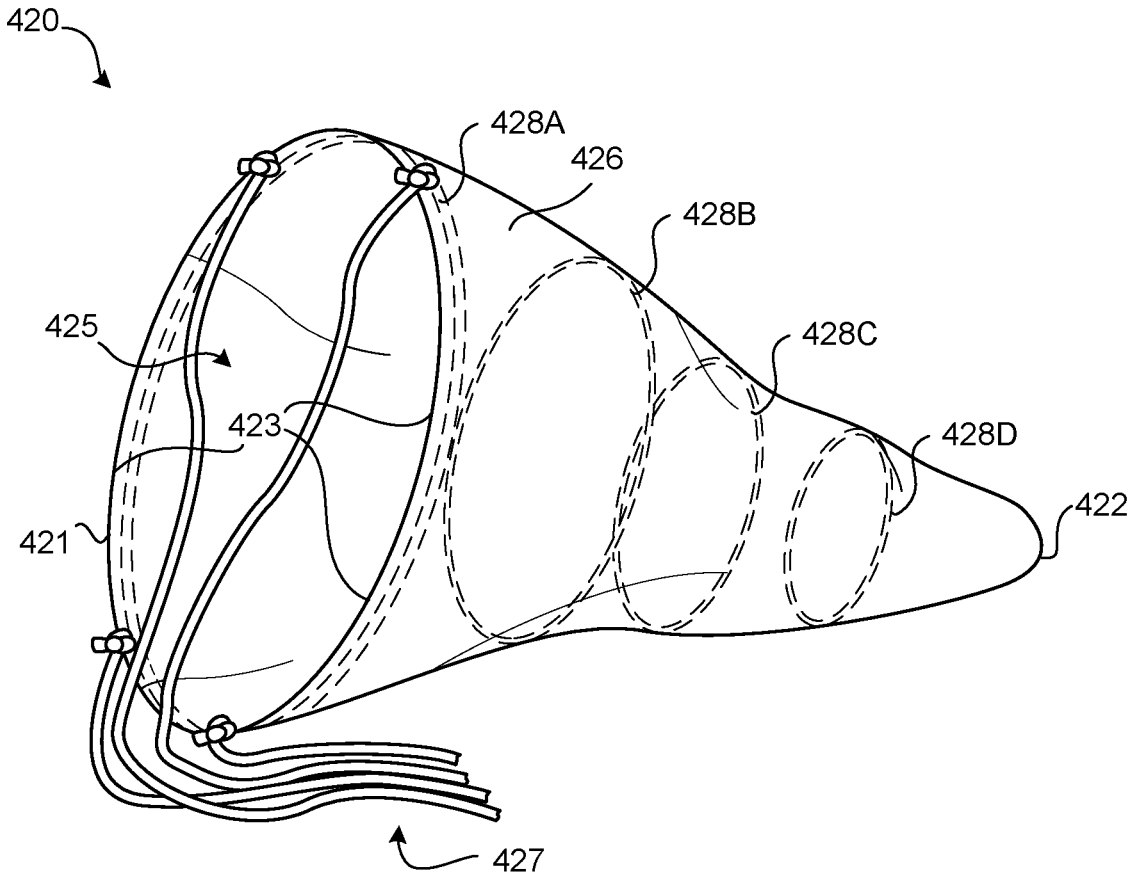
FIG. 4 is a perspective view of a sea anchor with a resiliently flexible support having a plurality of rings, in accordance with various embodiments.

In various embodiments, and with reference to FIG. 4, the resiliently flexible support of the sea anchor 420 includes a plurality of rings 428A, 428B, 428C, and 428D. For example, ring discussed above with reference to FIGS. 2A-3 may be a first ring 428A disposed around the mouth 425 and adjacent to the rim 423 at the first end 421 of the textile tube 426 of the sea anchor 420. The sea anchor 420 may further include a second ring 428B, a third ring 428C, and/or a fourth ring 428D. The second ring 428B may be coupled to the textile tube 426 at a location between the base of the conical shape (e.g., the first end 421) and the point of the conical shape (e.g., the second end 422), and thus the second ring 428B may have a smaller diameter than the first ring 428A.

Figure 5:
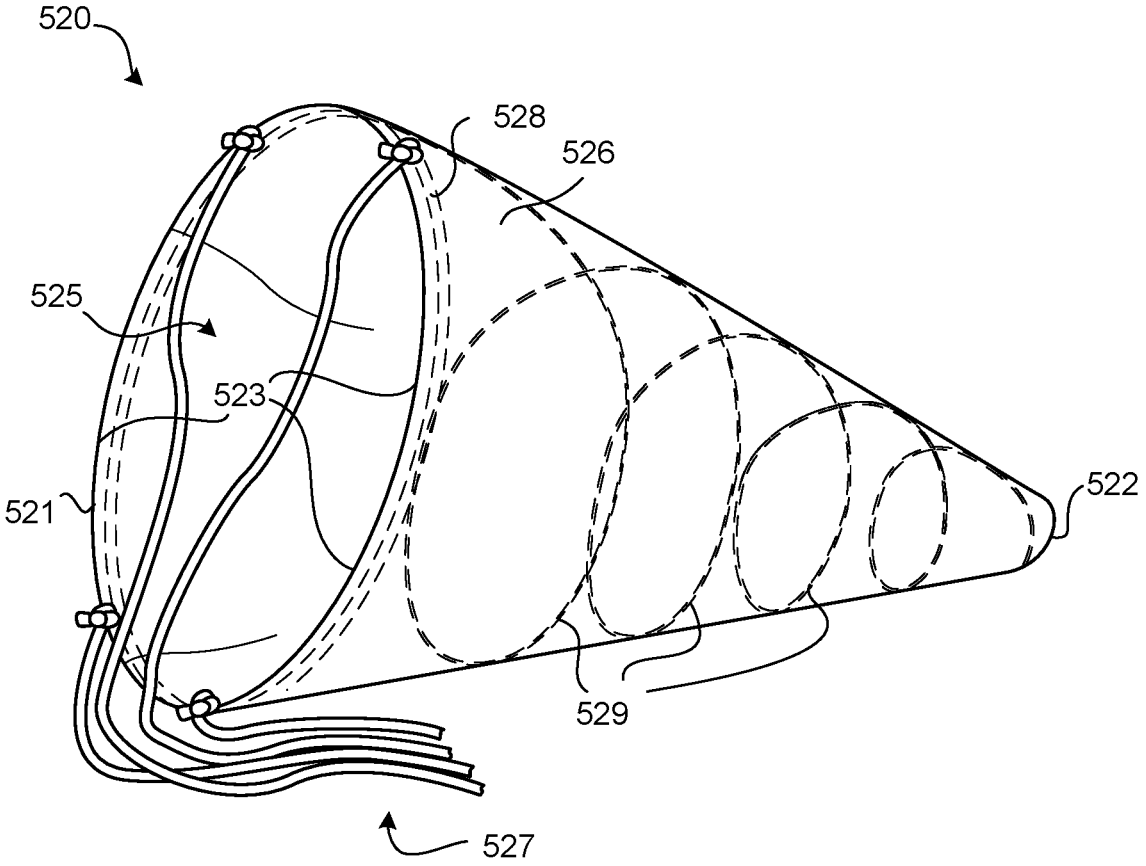
FIG. 5 is a perspective view of a sea anchor with a resiliently flexible support having a conic helix wire, in accordance with various embodiments.

In various embodiments, and with reference to FIG. 5, the resiliently flexible support of the sea anchor 520 includes the ring 528 disposed around the mouth 525 and adjacent to the rim 523 at the first end 521 of the textile tube 526 and the resiliently flexible support further includes a conic helix wire 529 coupled to the textile tube 526 and extending in a tapered spiral from the ring 528 towards the point (e.g., the second end 522) of the textile tube 526. The conic helix wire 529 may further facilitate self-deployment of the sea anchor after the constraints/fastener releases the sea anchor, with the resiliently flexible support 528 serving as a propulsion spring to propel the sea anchor 520 away from the life raft 100. The conic helix wire 529 may also provide a degree of structural rigidity to the textile tube 526, thereby further promoting the effectiveness of the sea anchor 520 in creating drag.

Figure 6:
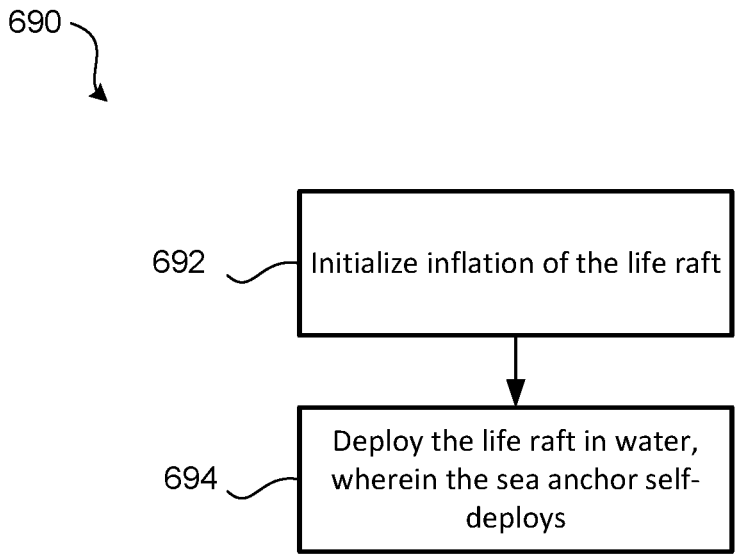
FIG. 6 is a schematic flow chart diagram of a method of using a life raft, in accordance with various embodiments.

In various embodiments, and with reference to FIG. 6, a method 690 of using the life raft 100 is provided. The method 690 may include initializing inflation of the life raft 100 at step 692 and deploying the life raft 100 in water, wherein the sea anchor self-deploys at step 694. That is, deploying the life raft 100 may be step 694, and the sea anchor may automatically self-deploy in response to inflation of the life raft 100. In various embodiments, the sea anchor is coupled to the life raft 100 in a collapsed shape prior to the inflation of the life raft 100, and the sea anchor transitions from the collapse shape to the expanded shape in response to the inflation of the life raft 100. This transition/expansion may cause the sea anchor to propel itself a distance away from the life raft 100. In various embodiments, a releasable fastener or a breakable fastener may be used to couple the sea anchor to the life raft 100 prior to the inflation of the life raft 100, and the fastener may release the sea anchor in response to expansion of the inflatable structure 110. That is, the expansion force of the inflation may force the releasable fastener to release and/or may break the breakable fastener.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A sea anchor comprising:

a textile tube comprising a first end and a second end, wherein the textile tube comprises a conical shape, wherein the first end comprises a rim defining a mouth that forms a base of the conical shape and the second end is tip of the conical shape; and a resiliently flexible support coupled to the first end, wherein the resiliently flexible support, in response to the sea anchor being deployed, is configured to expand the mouth and retain the mouth open, wherein the resiliently flexible support is a ring coupled to the rim of the first end that forms the mouth, wherein the resiliently flexible support further comprises a conic helix wire coupled to the textile tube, wherein the conic helix wire extends in a tapered spiral from the ring towards the tip of the conical shape at the second end of the textile tube.

2. The sea anchor of claim 1, wherein the resiliently flexible support comprises a metallic material.

3. The sea anchor of claim 1, wherein the resiliently flexible support comprises a plurality of rings, wherein the ring is a first ring of the plurality of rings, wherein a second ring of the plurality of rings is coupled to the textile tube at a location between the base and the point of the conical shape, wherein the second ring has a smaller diameter than the first ring.

4. The sea anchor of claim 3, wherein the plurality of rings comprises a third ring and a fourth ring.

* * * * *